US011289232B2

(12) United States Patent
Won et al.

(10) Patent No.: US 11,289,232 B2
(45) Date of Patent: Mar. 29, 2022

(54) CHEMICAL DECONTAMINATION METHOD USING CHELATE FREE CHEMICAL DECONTAMINATION REAGENT FOR REMOVAL OF THE DENSE RADIOACTIVE OXIDE LAYER ON THE METAL SURFACE

(71) Applicants: KOREA ATOMIC ENERGY RESEARCH INSTITUTE, Daejeon (KR); KOREA HYDRO AND NUCLEAR POWER CO., LTD., Gyeongsangbuk-do (KR)

(72) Inventors: Hui-Jun Won, Daejeon (KR); Chong-Hun Jung, Daejeon (KR); Sang Yoon Park, Daejeon (KR); Wangkyu Choi, Daejeon (KR); Jung-Sun Park, Chungcheongbuk-do (KR); Jeikwon Moon, Daejeon (KR); In-Ho Yoon, Chungcheongbuk-do (KR); Byung-Seon Choi, Daejeon (KR)

(73) Assignees: KOREA ATOMIC ENERGY RESEARCH INSTITUTE, Daejeon (KR); KOREA HYDRO AND NUCLEAR POWER CO., LTD., Gyeongsangbuk-Do (KR)

( * ) Notice: Subject to any disclaimer, the term of this patent is extended or adjusted under 35 U.S.C. 154(b) by 1004 days.

(21) Appl. No.: 16/102,797

(22) Filed: Aug. 14, 2018

(65) Prior Publication Data

US 2019/0027263 A1 Jan. 24, 2019

Related U.S. Application Data

(62) Division of application No. 14/017,728, filed on Sep. 4, 2013, now abandoned.

(30) Foreign Application Priority Data

Jan. 24, 2013 (KR) ..... 10-2013-0008013

(51) Int. Cl.
*G21F 9/00* (2006.01)
*C23G 1/02* (2006.01)
(Continued)

(52) U.S. Cl.
CPC ..... *G21F 9/004* (2013.01); *C23G 1/02* (2013.01); *C23G 1/085* (2013.01); *C23G 1/10* (2013.01); *C23G 1/106* (2013.01)

(58) Field of Classification Search
CPC . G21F 9/004; G21F 9/001; G21F 9/00; C23G 1/02; C23G 1/085; C23G 1/10; C23G 1/106; C02F 2101/006; C02F 1/00
See application file for complete search history.

(56) References Cited

U.S. PATENT DOCUMENTS 4,226,640 A * 10/1980 Bertholdt ..... G21F 9/004 134/28
5,183,541 A 2/1993 Snyder et al.
(Continued)

FOREIGN PATENT DOCUMENTS

CN 101796592 A * 8/2010 ..... G21F 9/06
EP 1422724 A3 6/2004
(Continued)

OTHER PUBLICATIONS

English Abstract for International Application Publication No. WO 0204707 A1, published Jan. 17, 2002, 1 pg.
(Continued)

*Primary Examiner* — Darlene M Ritchie
(74) *Attorney, Agent, or Firm* — Fredrikson & Byron, P.A.

(57) ABSTRACT

A chemical decontamination reagent containing a reducing agent, a reductive metal ion, and an inorganic acid is provided to remove a radioactive oxide layer on a metal surface. The reagent can dissolve the radioactive oxide layer
(Continued)

on the metal surface effectively at a relatively low temperature and enables a simple process of contacting the reagent to the radioactive oxide, thus economically effective in terms of cost and time required for the process. Since the decontamination does not use a conventional organic chelating agent such as oxalic acid, but the reducing agent as a main substance, the residuals of the reducing agent remained after decontamination can be decomposed and removed with an oxidizing agent. Due to the easy decomposition with the chemical decontamination reagent, secondary wastes can be minimized and the radionuclides remained in the decontamination reagent solution can be removed effectively.

9 Claims, 7 Drawing Sheets

(51) Int. Cl.
*C23G 1/08* (2006.01)
*C23G 1/10* (2006.01)

(56) References Cited

U.S. PATENT DOCUMENTS 6,335,475 B1 1/2002 Nagase et al.
6,875,323 B2 4/2005 Yaita et al.
6,973,154 B2 12/2005 Nagase et al.
7,931,753 B2 * 4/2011 Bitter ..... G21F 9/30 134/22.18
2002/0099252 A1 7/2002 Nagase et al.
2002/0150523 A1 * 10/2002 Nagase ..... G21F 9/004 422/159
2008/0190450 A1 8/2008 Bertholdt et al.
2009/0261039 A1 * 10/2009 Paillard ..... C02F 9/00 210/638
2014/0037037 A1 * 2/2014 Ito ..... G21F 9/12 376/306

FOREIGN PATENT DOCUMENTS

EP 2056302 A1 5/2009
JP 05255874 A 10/1993
JP 07097694 A * 4/1995 ..... C23G 1/088
JP 07097694 A 4/1995
JP 2007270222 A 10/2007
KR 1006055580000 B1 7/2006
KR 1008569440000 B1 9/2008
WO 0204707 A1 1/2002

OTHER PUBLICATIONS

Stiepani, et al., "Full System Decontamination with HP/CORD UV for Decomissioning of the German PWR Stade," 18th International Conference on Structural Mechanics in Reactor Technology (2005).
Prince, et al., "Dissolution Behavior of Magnetite Film Formed over Carbon Steel in Dilute Organic Acid Media," Journal of Nuclear Materials (2001).

* cited by examiner

[Fig. 5]
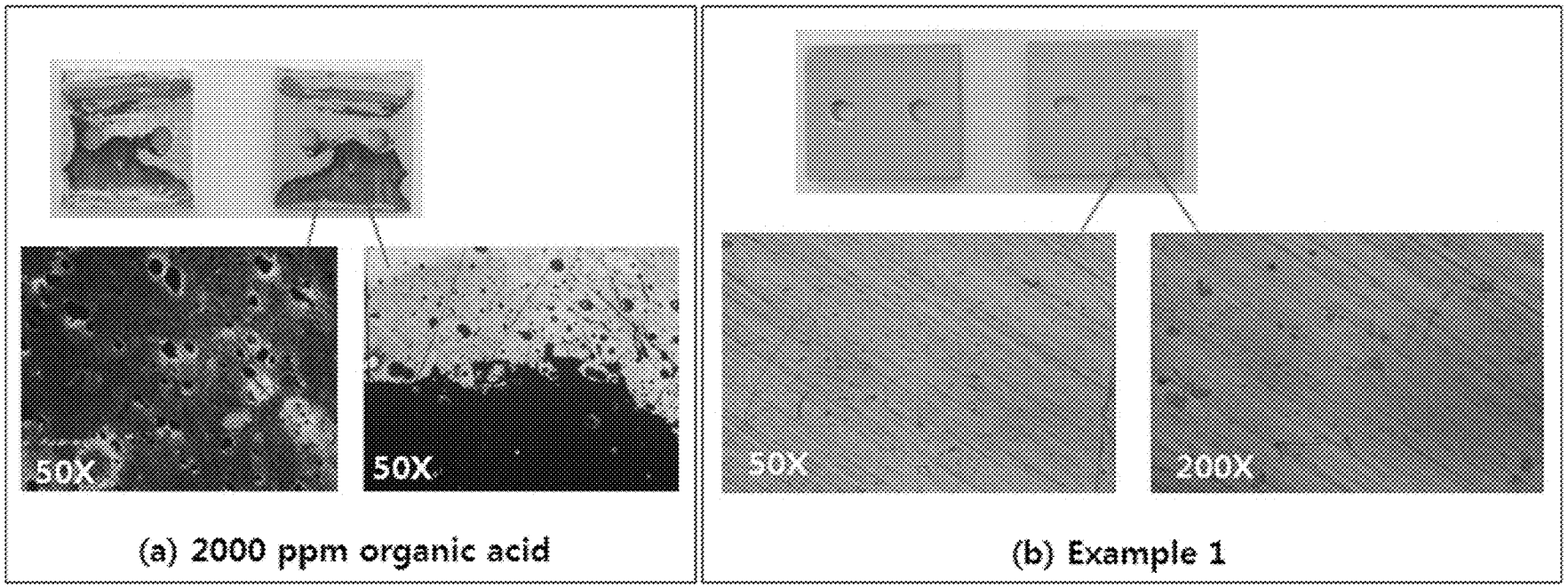

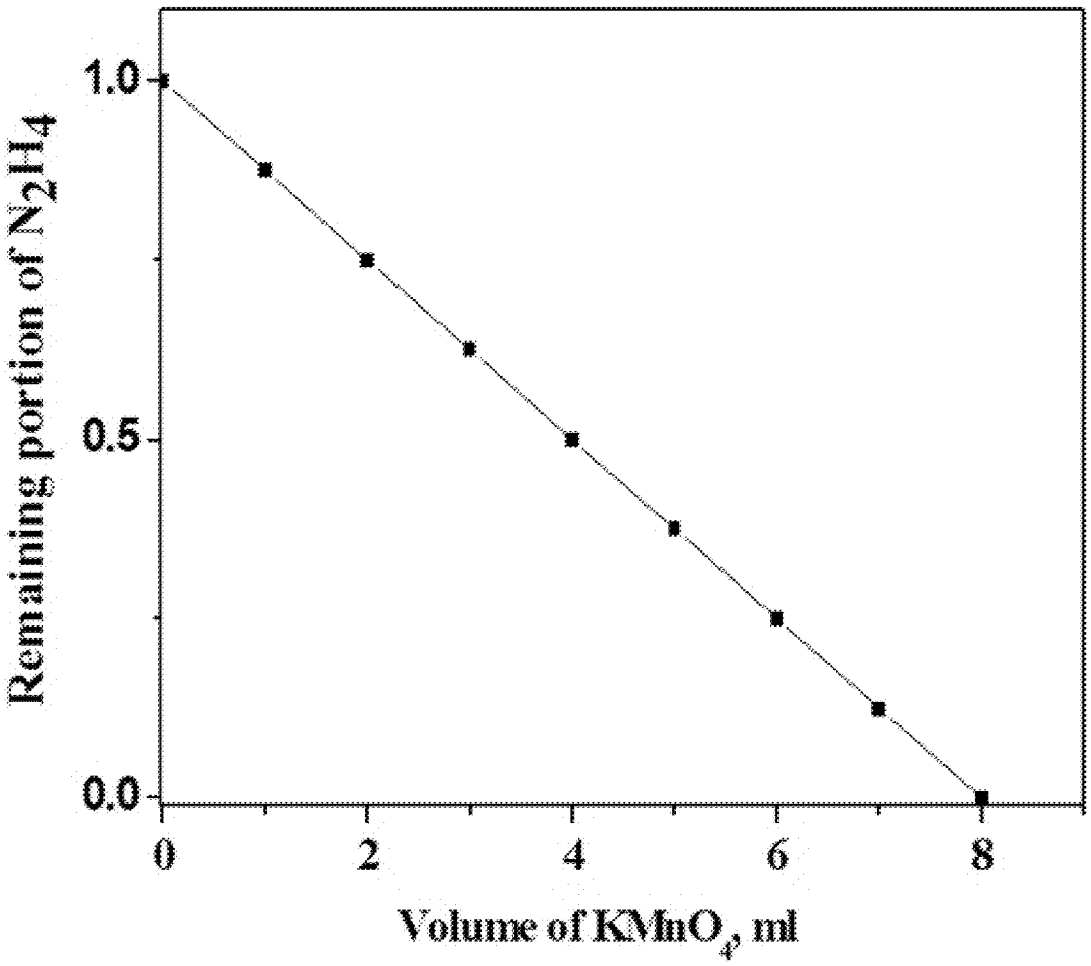
[Fig. 6]

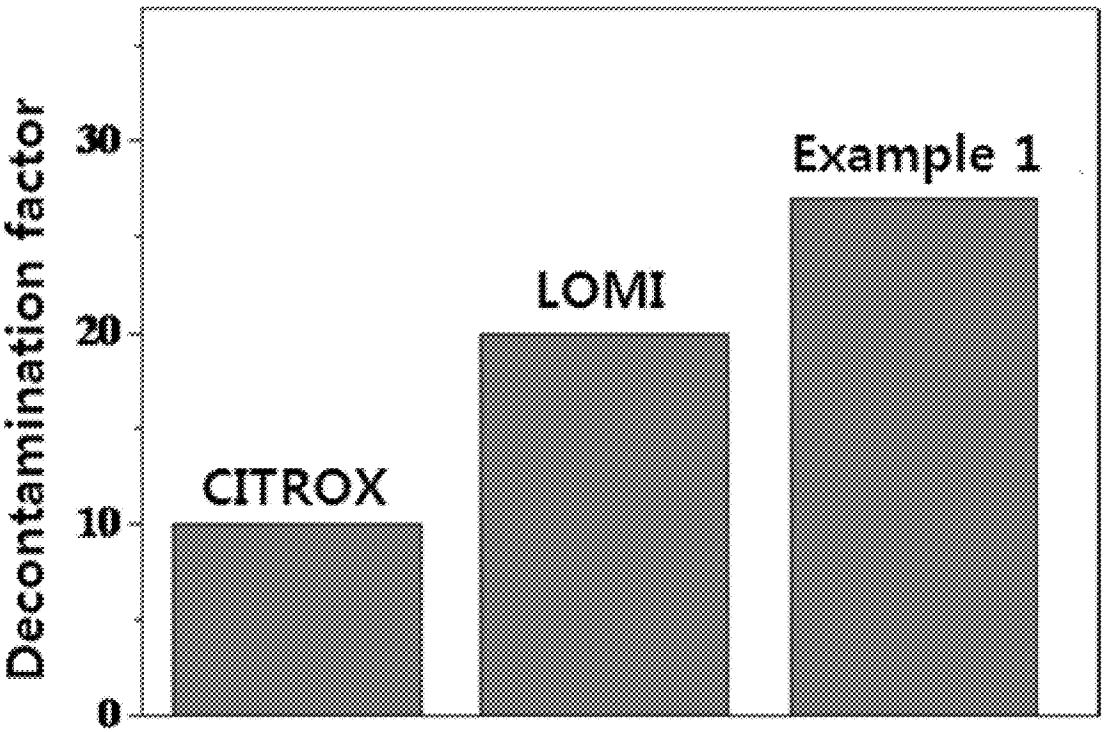
【Fig. 7】

CHEMICAL DECONTAMINATION METHOD USING CHELATE FREE CHEMICAL DECONTAMINATION REAGENT FOR REMOVAL OF THE DENSE RADIOACTIVE OXIDE LAYER ON THE METAL SURFACE

CROSS-REFERENCE TO RELATED APPLICATIONS

This is a divisional application of application Ser. No. 14/017,728, filed Sep. 4, 2013, which claims priority from Korean Patent Application No. 10-2013-0008013, filed on Jan. 24, 2013, in the Korean Intellectual Property Office, the disclosure of which is incorporated herein by reference in its entirety.

BACKGROUND

1. Field of the Invention

The present invention relates to a low concentration chelate free chemical decontamination reagent effective for removal of the dense radioactive oxide layer fixed on a metal surface and a chemical decontamination method using the same.

2. Description of the Related Art

The primary metal components of the nuclear power plant system are subject to corrosion problem due to steam or coolant circulating the nuclear power plant, and a dense metal oxide layer forms on the metal surface. The metal oxide includes radionuclides that result in increased radiation level at and around the internal of nuclear power plant.

Furthermore, there is a risk of inevitable radiation exposure for the relevant workers (power plant operators, maintenance workers) or other workers near the site, due to the radiation emitted from the radioactive material deposit in the nuclear power plant system.

As an effort to reduce radiation exposure of the workers in the nuclear power plant, various methods have been studied around the world, mainly focused on the ways to effectively remove the dense oxide layer attached to steam generator channel head and coolant pump which are the main causes of the radiation exposure of the workers.

The decontamination technology developed so far includes the chemical decontamination technology using high concentration and low concentration organic, inorganic-acid decontamination reagent, the mechanical decontamination technology using cleaning, polishing, or high-pressure ejection, and the electrical decontamination technology.

The above and other various conventionally-commercialized chemical decontamination technologies use organic acid chelating agent such as oxalic acid, ethylenediaminetetraacetic acid (EDTA), or picolinic acid, that is known to form strong chelates.

(1) For example, CITROX, a first developed low-concentration chemical decontamination technology, uses a mixture of organic chelating agent and salt. (oxalic acid—2.5 wt %, dibasic ammonium citrate—5 wt %, and ferric nitrate—2 wt %).

(2) CAN-DECON and CAN-DEREM, which were developed in Canada by improving the CITROX, use a chemical called LND-101A containing EDTA:citric acid:oxalic acid=2:1:1.

(3) LOMI, which was developed by a joint effort of the United Kingdom and the United States, uses organic chelating agent such as picolinic acid and vanadium ion, a reduced metal ion, to retain iron ion in a chelate form in the solution.

(4) CORD, which was developed in Germany, also uses organic chelating agent such as oxalic acid. However, it has been reported that CORD may produce a precipitate in an oxalate form during decontamination, making the purification process difficult.

Meanwhile, other conventional decontamination technologies applicable to the primary coolant systems (steam generator, coolant pump, etc) of nuclear power plants use organic chelating agent such as oxalic acid, EDTA, and PDCA.

(1) For example, Stiepani, et al. from Germany presented "Full System Decontamination with HP/CORD UV for Decommissioning of the German PWR Stade" at the 18th International Conference on Structural Mechanics in Reactor Technology in 2005.

The presenters reported that a repetitive application of oxalic acid and permanganic acid can effectively decontaminate the primary coolant system and auxiliary system of nuclear power plants and significantly reduce the dose of radiation to which workers at the nuclear power plants are exposed.

(2) Prince, et al. published "Dissolution Behavior of Magnetite Film Formed over Carbon Steel in Dilute Organic Acid Media" in Journal of Nuclear Materials in 2001. The authors used EDTA, EDTA-citric acid, EDTA-citric acid-ascorbic acid system and pyridinedicarboxylic acid (PDCA), PDCA-citric acid, and PDCA-citric acid-ascorbic acid system to dissolve the oxide layer.

Further, prior art documents discussing technologies for decontaminating radioactive metal oxides also involve use of the organic chelating agent such as oxalic acid as a chemical reagent for decontamination.

(1) For example, U.S. Pat. No. 6,973,154 relates to a chemical decontamination method which decontaminates radioactive nuclides from a metallic material, by introducing oxalic acid and hydrazine as a reductive decontamination reagent into aqueous solution, contacting the solution with the metallic material, and decomposing the reductive decontamination reagent with an oxidizing agent such as hydrogen peroxide.

(2) U.S. Pat. No. 1,422,724 discloses decontaminating radioactive metal surface by repeating reducing dissolution and oxidizing dissolution, using reductive decontamination reagent such as formic acid and oxalic acid, and an oxidizer such as ozone, permanganic acid or permanganate, and feeding hydrogen peroxide to decompose the reducing agent.

(3) U.S. Pat. No. 6,875,323 discloses decontamination of radioactive metal surface, using oxidizer with a high concentration ozone generated by solid electrolyte electrolytic process, and a reducer such as oxalic acid. According to U.S. Pat. No. 6,875,323, the oxalic acid is removed by irradiation of UV ray along with ozone, and ions within oxalic acid liquid are removed by ion-exchange resin.

(4) U.S. Pat. No. 6,335,475 discloses use of 0.05-0.3 wt % oxalic acid and hydrogen peroxide and catalyst such as Pd, Ur, Rh, V, Pd, IR to decompose the reductive decontamination reagent.

(5) KR 0856944 discloses a method of diluted chemical decontamination of nuclear power plant (NP) coolant pump internal components which are contaminated with radioactive substance, which includes process of oxidation, decomposition and reduction, and which uses oxalic acid, i.e., the organic acid chelating agent for the reducing agent of reductive dissolution process, and which applies short time for each step within less than 4 hours.

(6) KR 0605558 discloses a chemical decontamination apparatus and a method thereof using ultrasonic waves and organic acid, for main component of a primary coolant system of a nuclear plant such as steam generator or coolant pump of the nuclear plant, which use a decontamination reagent such as oxalic acid, EDTA and ascorbic acid, and which applies 12 hours for reducing process.

As explained above, all the prior arts use organic acid chelating agent such as oxalic acid, formic acid or EDTA to dissolve iron component existing in the radioactive oxide layer, in chemically decontaminating radioactive-contaminated primary system, NP coolant pump or metal waste.

However, use of organic acid chelating agent is inefficient because it is necessary to decompose the chelating agent or adsorb this to an ion exchange resin to minimize the amount of radioactive waste that is generated after the decontamination. Additionally, a separate apparatus such as UV emitter is necessary to decompose the organic acid chelating agent, or the chelating agent itself remains as nuclear waste when incompletely decomposed. Further, even when the organic acid chelating agent is adsorbed on the ion exchange resin, this causes greatly deteriorated safety of disposing radioactive waste.

Accordingly, during a continuous search for a chelate-free low concentration chemical decontamination reagent which is effective in removing dense radioactive oxide layer fixed on a metal surface without having to use organic acid chelating agent such as oxalic acid and the others, the present invention discovered that a chemical decontamination reagent containing reducing agent, reductive metal ion and inorganic acid can effectively and economically remove radioactive oxide layer, and thus completed the present invention.

SUMMARY OF THE INVENTION

It is an objective according to an embodiment to provide a chelate-free low-concentration chemical decontamination reagent which is effective in removing a radioactive oxide layer on a metal surface and a chemical decontamination method using the same.

In order to achieve the aforementioned objective, in one embodiment, a chelate-free chemical decontamination reagent containing a reducing agent, reductive metal ion, and inorganic acid to remove a radioactive oxide layer on a metal surface, is provided.

The chemical decontamination reagent according to an embodiment uses one or more reducing agent selected from the group consisting of $NaBH_4$, $H_2S$, $N_2H_4$ and $LiAlH_4$.

The chemical decontamination reagent according to an embodiment uses one or more metal ion selected from the group consisting of $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Sn^{2+}$, $Sn^{4+}$, $Ti^{2+}$, and $Ti^{3+}$ as the reductive metal ion.

The chemical decontamination reagent according to an embodiment uses one or more inorganic acid selected from the group consisting of HBr, HF, HI, $HNO_3$, $H_3PO_4$, and $H_2SO_4$.

Further, in one embodiment, a method for preparing the chemical decontamination reagent is provided, which includes the following steps of:

preparing a solution by mixing a reducing agent in distilled water (step 1);

adding an inorganic acid into the solution of step 1 (step 2); and adding a metal ion into the solution of step 2 (step 3).

Furthermore, in one embodiment, a chemical decontamination method includes a step of contacting the chemical decontamination reagent to a metal covered with a dense radioactive oxide layer.

The chemical decontamination reagent according to embodiments can provide efficient decontamination process, since this can dissolve and remove a radioactive oxide layer on a metal surface effectively at a proper temperature, and effect decontamination through the process of contacting the chemical decontamination reagent to the radioactive oxide layer.

Further, the chemical decontamination reagent according to embodiments can decompose and remove easily the reducing agent remaining after decontamination, since the chemical decontamination reagent mainly uses reducing agent, without using organic chelating agent such as oxalic acid, and due to an easy decomposition of the decontamination reagent, the chemical decontamination reagent can provide the effect such as minimized generation of secondary radioactive waste and effective removal of radionuclide remaining in the decontamination solution.

BRIEF DESCRIPTION OF THE DRAWINGS

The foregoing and/or other aspects according to an embodiment will be more apparent upon reading the description of certain exemplary embodiments with reference to the accompanying drawings, in which:

FIG. 5 shows the images obtained after treating a crevice-type specimen with the chemical decontamination reagent of Example 1 and a conventional organic acid decontamination reagent and observing the treated crevice-type specimen through an electron microscope ((a) obtained after treating the specimen with 2000 ppm organic acid decontamination reagent (CORD); and (b) obtained after treating the specimen with the chemical decontamination reagent of Example 1).

FIG. 6 is a graph showing the decreasing concentration of hydrazine ($N_2H_4$) in the chemical decontamination reagent when using $KMnO_4$ as an oxidizing agent for the chemical decontamination reagent of Example 1 containing hydrazine ($N_2H_4$) as a main reducing agent.

FIG. 7 is a graph showing the comparison of decontamination efficiencies when using the chemical decontamination reagent of Example 1 and a conventional organic acid decontamination reagent (CITROX, LOMI) after pre-treating the radioactive specimen of a primary system (SUS 304) with NP (nitric acid+potassium permanganate).

DETAILED DESCRIPTION OF EXEMPLARY EMBODIMENTS

Figure 1:
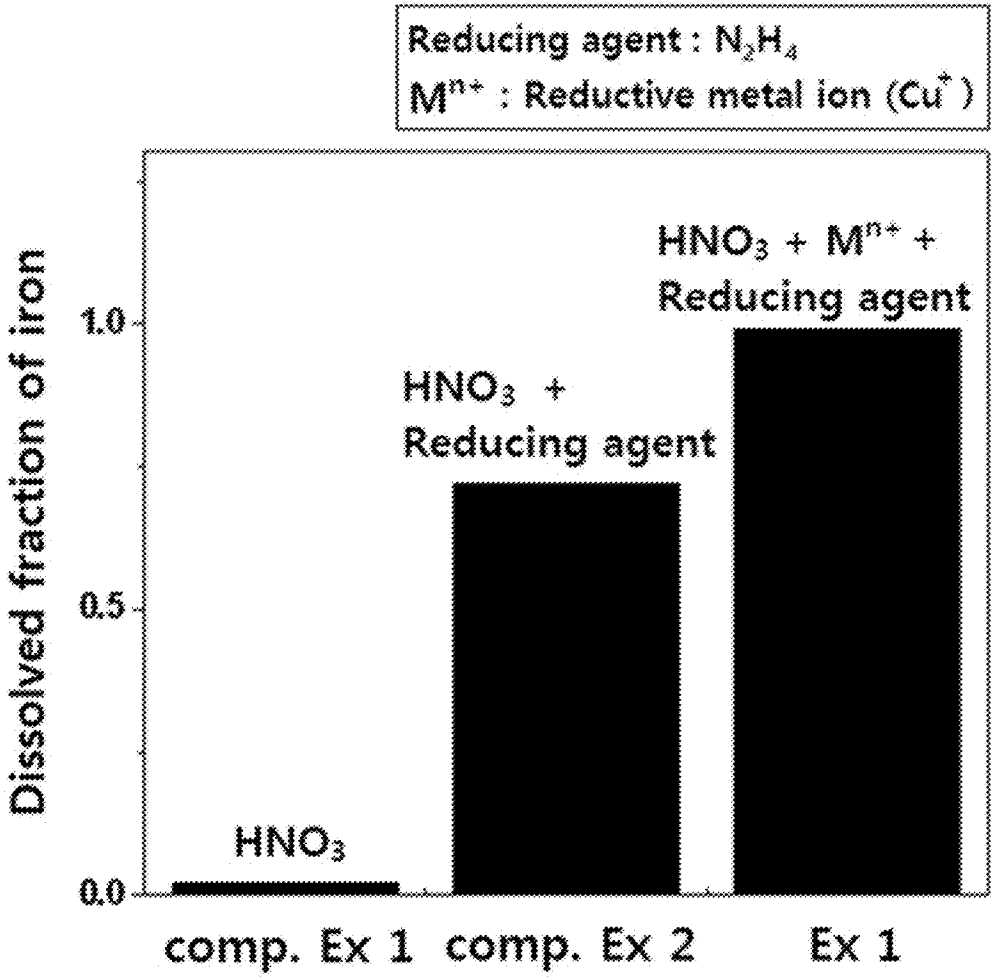
FIG. 1 is a graph showing dissolved iron fractions of a model iron oxide, which is obtained by using the chemical decontamination reagents prepared in accordance with Example 1 and Comparative Examples 1-2 according to an embodiment.

The present invention will be explained below with reference to embodiments and drawings.

In one embodiment, the present invention provides chelate-free chemical decontamination reagent containing reducing agent, reductive metal ion and inorganic acid, for removal of the dense radioactive oxide layer on the metal surface.

Conventionally, the radioactive metal oxide layer is dissolved and removed by organic acid chelating agent such as oxalic acid, formic acid, or EDTA. However, the conventional decontamination suffers shortcomings associated with use of organic acid chelating agent, since the organic acid chelating agent has to be decomposed or adsorbed onto ion-exchange resin to minimize the amount of radioactive waste remaining after the decontamination. Further, decomposition of the organic acid chelating agent requires a separate equipment such as UV emitter, and incompletely decomposed organic acid chelating agent remains as radioactive waste. Further, when the organic acid chelating agent is adsorbed to ion exchange resin, this also severely deteriorates radioactive waste disposal safety.

The present invention provides advantages because, since metal component present in the radioactive contaminant metal oxide layer is effectively dissolved, radioactivity is easily removed without requiring use organic acid chelating agent such as oxalic acid or the like. Additionally, since reducing agent is used as a main decontaminating reagent, the remaining reducing agent is easily decomposed with oxidative agent after use. Accordingly, secondary radioactive waste is minimized since the decontamination reagent is decomposed efficiently, and the radioactive nuclide remaining in the decontamination liquid can be removed effectively.

Further, the chemical decontamination reagent according to an embodiment can perform decontamination process at a lower temperature and provide more effective radioactive removal, since reductive metal ion acts as a catalyst.

To be specific, the chemical decontamination reagent according to an embodiment includes the reducing agent which is one or more selected from the group consisting of $NaBH_4$, $H_2S$, $N_2H_4$, $LiAlH_4$. The reducing agent plays a role of removing radioactive metal oxide layer through the reduction dissolution reaction of Reaction Formula 1.

$$Fe_3O_4+2e^-+8H^+\rightarrow 3Fe^{2+}+4H_2O \quad \text{[Reaction Formula 1]}$$

($Fe_3O_4$ denotes iron oxide which is an example of radioactive metal oxide layer.)

Further, the chemical decontamination reagent according to an embodiment uses oxidizing liquid as a pretreatment agent to increase the velocity of dissolution of the reducing agent and to increase decontamination effect. The oxidizing liquid may include, for example, nitric acid+potassium permanganate (NP) which is oxidizing liquid added with potassium permanganate, alkaline potassium permanganate which is basic liquid added with potassium permanganate, or ozone ($O_3$).

Additionally, the secondary waste amount may be reduced by decomposing and removing the reducing agent after use, with the use of the oxidizer or hydrogen peroxide solution.

In the chemical decontamination reagent according to an embodiment, the reductive metal ion is one or more metal ions selected from the group consisting of $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Sn^{2+}$, $Sn^{4+}$, $Ti^{2+}$, and $Ti^{3+}$. The reductive metal ion promotes the removal of radioactive metal oxide layer by the dissolution reaction of the metal in the radioactive metal oxide layer, as expressed by the following reaction formula 2.

$$Fe_3O_4+2M^++8H^+\rightarrow 3Fe^{2+}+2M^{2+}+4H_2O \quad \text{[Reaction Formula 2]}$$

($M^+$ denotes the reductive metal ion.)

In the chemical decontamination reagent according to an embodiment, the inorganic acid is one or more inorganic acids selected from a group consisting of HBr, HI, HF, $HNO_3$, $H_3PO_4$, and $H_2SO_4$.

The inorganic acid removes the radioactive metal oxide layer by the acid dissolution of the following reaction formula 3.

$$Fe_3O_4+8H^+\rightarrow 2Fe^{3+}+Fe^{2+}+4H_2O \quad \text{[Reaction Formula 3]}$$

Meanwhile, in one embodiment, the metal surface chelate radioactive oxide layer is produced inside the nuclear power plant system.

The main metal components of the nuclear plant systems can suffer corrosion as the steam or coolant circulates the nuclear power plant, which can be formed into dense metal oxide layer on the surface thereof from a small amount of corrosion product. Since the metal oxide contains radioactive nuclide, the accumulated radioactive materials in the systems can expose the workers to increased radiation. Accordingly, the chemical decontamination reagent according to embodiments is particularly advantageous in the removal of dense radioactive oxide layer on the metal surface generated inside the nuclear power plant systems.

According to an embodiment, the metal having the radioactive oxide layer thereon may be one or more selected from a group consisting of stainless steel, Inconel steel, and Zirconium alloy.

According to an embodiment, the concentration of the reducing reagent is preferably in the range of $5\times10^{-4}$-0.5 M. If the concentration of the reducing reagent is less than $5\times10^{-4}$ M, the reducing property may not be active sufficiently. If the concentration is greater than 0.5 M, it is undesirable, since it may consume increased amount of chemical reagent for decomposition after the decontamination.

According to an embodiment, the concentration of the reductive metal ion may desirably be $1\times10^{-5}$~0.1 M. If the concentration of the reductive metal ion is less than $1\times10^{-5}$ M, decontamination efficiency may deteriorate. On the contrary, if the concentration of the reducing metal exceeds 0.1 M, a metallic precipitate may be formed.

Further, the concentration of the inorganic acid may desirably be $1\times10^{-4}$~0.5 M. If the concentration of the inorganic acid is less than $1\times10^{-4}$ M, decontamination efficiency may deteriorate. On the contrary, if the concentration of the inorganic acid exceeds 0.5 M, an ample amount of neutralizer may be required.

The conventional high-concentration chemical decontamination using the decontaminating materials at a high concentration of 1 wt % or more may yield a large decontamination factor, but on the other hand, produce an ample amount of secondary wastes, whereas, the conventional low-concentration chemical decontamination using the decontaminating materials at a low concentration of less than 1 wt % may yield a small decontamination factor requiring a lengthened decontaminating time to reach a desired decontamination factor, but on the other hand, produce a small amount of secondary wastes facilitating the treatment thereof.

Although being a low-concentration chemical decontamination reagent containing a $5\times10^{-4}$-0.5M reducing agent, a $1\times10^{-5}$-0.1M reductive metal ion, and a $1\times10^{-4}$-0.5M inorganic acid, the chemical decontamination reagent according to an embodiment can perform decontamination effectively within a short period of time while generating less of secondary wastes and facilitating the treatment thereof.

Meanwhile, pH of the chemical decontamination reagent according to an embodiment can be regulated within a desirable range of 1.0 to 3.7 according to decontamination purpose. Although any pH in all range is applicable to decontamination before decomposition with no concern about corrosion of metallic materials, pH 1 or above is particularly applicable due to desirable decontamination efficiency. However, if the pH is less than 1.0 for decontamination during operation, metallic materials may be corroded. On the contrary, if the pH is over 3.7 for decontamination during operation, decontamination efficiency may deteriorate and also metallic precipitation may arise.

Compared to the conventional low-concentration chemical decontamination reagent, the chemical decontamination reagent according to the present invention has an improved decontaminating performance and thus can reduce the decontaminating time and secondary wastes.

For example, compared to the conventional chemical decontamination reagents, i.e., CITROX (2.5 wt % oxalic acid, 5 wt % ammonium citrate dibasic, and 2 wt % ferric nitrate) and LOMI (picolinic acid $1\text{-}2\times10^{-2}$M, $V^{+2}$ icon $2\text{-}4\times10^{-3}$M, formic acid $1\text{-}2\times10^{-2}$M), the decontamination reagent according to an embodiment may reduce secondary radioactive wastes. Further, compared to CANDECON (EDTA:citric acid:oxalic acid=2:1:1, 1000-2000 ppm in total), the chemical decontamination reagent according to an embodiment has an improved treatment stability. Furthermore, compared to CORD (oxalic acid 2000±200 ppm), the chemical decontamination reagent retains a more desirable material integrity.

Further, the present invention provides a method for preparing the chemical decontamination reagent, which includes the following steps of:

preparing a solution by mixing a reducing agent in distilled water (step 1);

adding inorganic acid into the solution of step 1 (step 2); and adding a metal ion into the solution of step 2 (step 3).

Hereinafter, the method for preparing the chemical decontamination reagent according to an embodiment will be described in detail.

First, step 1 prepares a solution obtained through dissolution of a reducing agent in distilled water.

The reducing agent of step 1 is one or more selected from the group consisting of $NaBH_4$, $H_2S$, $N_2H_4$, and $LiAlH_4$. The concentration of the reducing agent dissolved in distilled water is desirably in the range of $5\times10^{-4}$-0.5 M.

Next, step 2 adds inorganic acid into the solution of step 1.

The inorganic acid of step 2 is one or more selected from the group consisting of HBr, HF, HI, $HNO_3$, $H_3PO_4$, and $H_2SO_4$. It is desirable to add the inorganic acid at a concentration of $1\times10^{-4}$-0.5 M.

The inorganic acid of step 2 plays a role of regulating the pH of the chemical decontamination reagent. It is desirable to regulate the pH of the decontamination reagent to 1.0-3.7 with the inorganic acid.

Lastly, step 3 adds a reductive metal ion into the solution of step 2.

The reductive metal ion of step 3 is one or more selected from the group consisting of $Ag^+$, $Ag^{2+}$, $Mn^{2+}$, $Mn^{3+}$, $Co^{2+}$, $Co^{3+}$, $Cr^{2+}$, $Cr^{3+}$, $Cu^+$, $Cu^{2+}$, $Sn^{2+}$, $Sn^{4+}$, $Ti^{2+}$, and $Ti^{3+}$. It is desirable to add the reductive metal ion at a concentration of $1\times10^{5}$-0.1 M.

Further, the reductive metal ion of step 3 may be added in a form of ion or ion pair with the addition of metal salt. The metal salt such as $Cl^-$, $NO_3^-$, or $SO_4^{2-}$ may be used, but not limited thereto.

Meanwhile, the present invention provides a chemical decontamination method which includes the step of contacting the chemical decontamination reagent to the metal surface with a radioactive oxide layer attached thereto.

The chemical decontamination method may be performed by immersing the metal with a radioactive oxide layer attached thereto or passing the chemical decontamination reagent through the inside of the systems or loop of a nuclear power plant.

Also, the chemical decontamination method according to the present invention may preferably be performed at the temperature in the range of 70-140° C. If the decontamination temperature is less than 70° C., there may be problem of the reduced decontamination effect. If the decontamination temperature is more than 140° C., it is not preferable due to the problem of complicated process according to the increase of steam pressure.

Furthermore, the chemical decontamination method according to an embodiment may preferably be performed for 2-26 hr. If the decontamination is performed less than 2 hr, the reaction is not completely occurred, while the decontamination exceeding 26 hr is not desirable, since no further decontamination effect is obtained from then on.

The chemical decontamination method according to an embodiment can effectively remove radioactive oxide, since the reductive metal ion plays the role of catalyst, thus allowing decontamination to proceed at a lower temperature, and also is economically beneficial both in terms of cost and time, since decontamination is effected by the process of contacting the radioactive oxide to the chemical decontamination reagent.

Certain examples and experimental examples will be explained below. However, these are provided only for the purpose of illustration, and not to be construed as limiting.

<Example 1> Preparation of Reducing Agent+Reductive Metal Ion+Inorganic Acid-Based Chemical Decontamination Reagent The chemical decontamination reagent according to Example 1 according to an embodiment is prepared by dissolving $N_2H_4$ as Reducing agent to the distilled water at concentration of 0.07 M, adding 0.0005 M of $Cu^+$ as reductive metal ion, and adjusting pH to 3 by adding 0.07 M of nitric acid as inorganic acid.

<Comparative Example 1> Preparation of Inorganic Acid-Based Chemical Decontamination Reagent The chemical decontamination reagent according to the Comparative Example 1 is prepared by adding 0.003 M of nitric acid as inorganic acid to the distilled water.

<Comparative Example 2> Preparation of Reducing Agent+Inorganic Acid-Based Chemical Decontamination Reagent The chemical decontamination reagent according to Comparative Example 2 was prepared by adding 0.07 M of $N_2H_4$ as the reducing agent into distilled water, and adding 0.07 M of nitric acid as the inorganic acid.

<Experimental Example 1> Evaluation of Metal Oxide Dissolubility of Chemical Decontamination Reagent To evaluate the metal oxide dissolubility of the chemical decontamination reagent according to the present invention, the amount of dissolution of iron component from the simulated iron oxide by the chemical decontaminating reagents of Example 1 and Comparative Examples 1-2 was evaluated, as shown in FIG. 1.

The dissolubility evaluation of the metal oxide was conducted for 2 hr at 95° C., and FIG. 1 illustrates iron dissolubility with reference to 18 ppm of iron component concentration (i.e., dissolubility=1) in aqueous solution when the simulated iron oxide is completely dissolved at pH 3.

Referring to the result illustrated in FIG. 1, the chemical decontaminant reagent of Comparative Example 1 added with nitric acid only exhibited less than 0.002 of dissolubility after 2 hr at 95° C., the chemical decontaminant reagent of Comparative Example 2 added with nitric acid and reducing agent exhibited increased dissolubility of 0.072, and the chemical decontaminant reagent of Example 1 added with nitric acid, reducing agent and reductive metal ion exhibited complete dissolution of iron component, by dissolubility of 1.

From the above result, it was confirmed that the chemical decontaminant reagent according to the present invention, although being at low concentration, can effectively eliminate radioactive metal oxide, without using organic chelate.

<Experimental Example 2> Evaluation of Metal Oxide Dissolubility According to Concentration of Reducing Agent To investigate metal oxide dissolubility according to concentration of the reducing agent in the chemical decontaminant reagent according to the present invention, the concentration of $N_2H_4$, the reducing agent of the chemical decontamination reagent, was changed from 0.000007 M to 0.07 M in a condition where there is no reductive metal ion present, and the amount of dissolved iron component from the simulated iron oxide was evaluated while changing the concentration of nitric acid from 0.002 M to 0.07 M to maintain the liquid at pH 3. The result is shown in FIG. 2.

Figure 2:
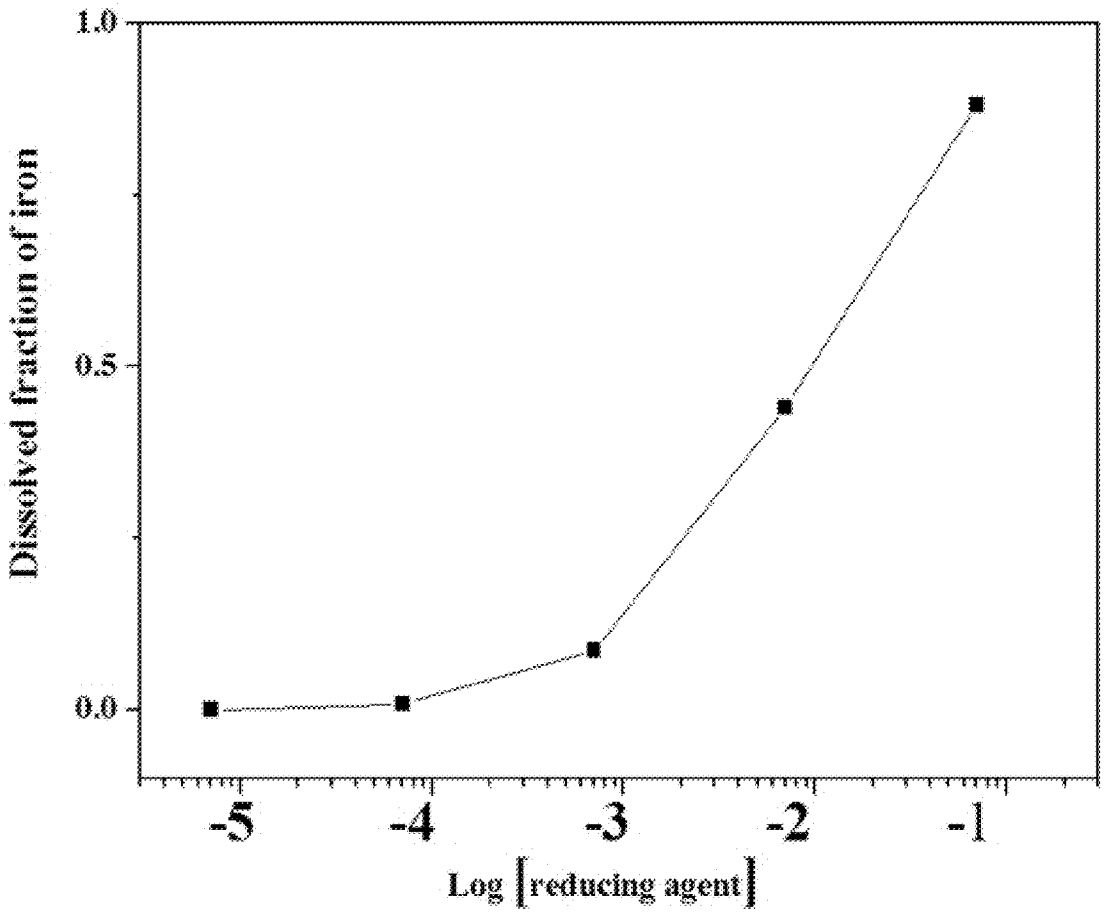
FIG. 2 is a graph showing the change in the dissolved iron fraction of a model iron oxide according to the concentration of the reducing agent ($N_2H_4$) in chemical decontamination reagent of Comparative Example 2.

The evaluation of the metal oxide dissolubility according to concentration of the reducing agent was conducted for 2 hr at 140° C., and FIG. 2 illustrates iron dissolubility with reference to 36 ppm of iron component concentration (i.e., dissolubility=1) in aqueous solution when the simulated iron oxide is completely dissolved at pH 3.

Referring to FIG. 2, it was confirmed that the 18 ppm of iron component was dissolved within 2 hr, when the concentration of the reducing agent of the chemical decontaminant reagent according to an embodiment was 0.007 M or above.

Accordingly, it was confirmed that the reaction slowly occurred at high temperature (i.e., 140° C.) when only the reducing agent ($N_2H_4$) was used.

Figure 3:
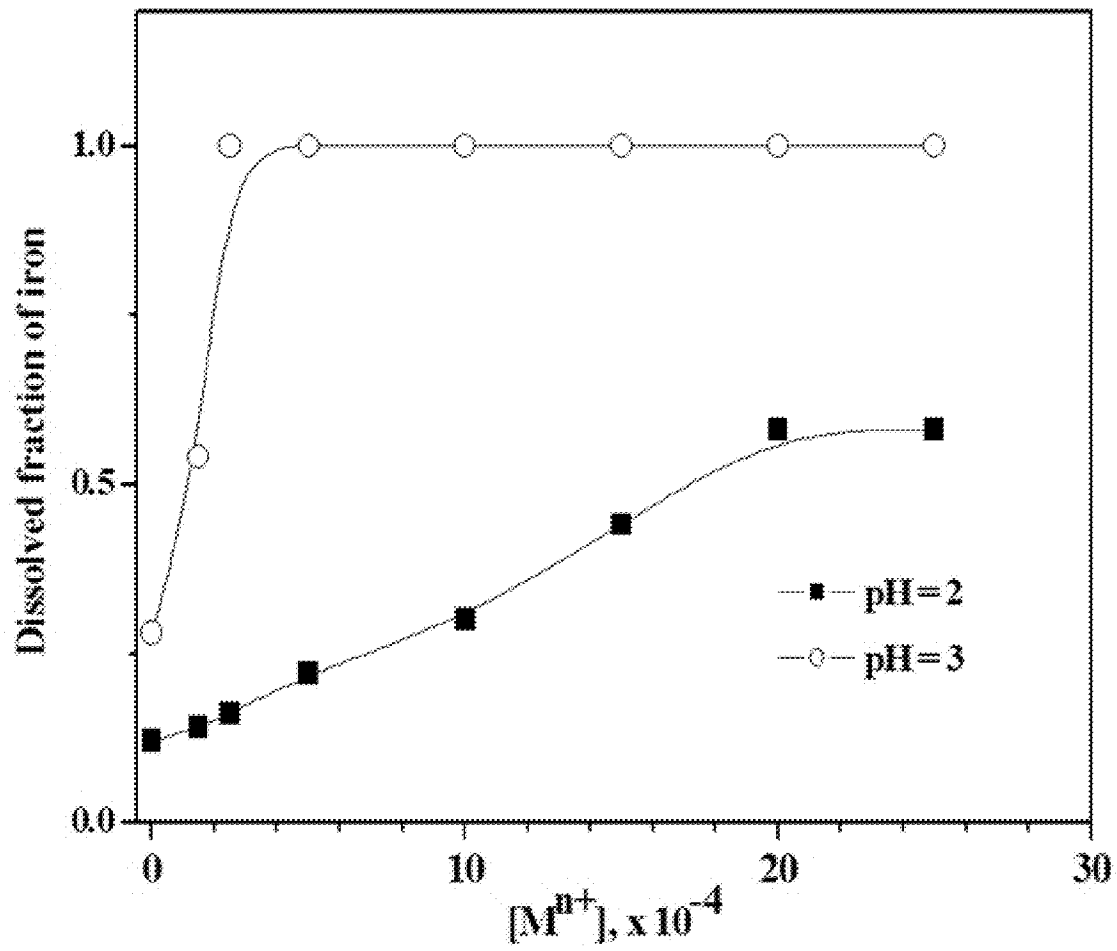
FIG. 3 is a graph showing the change in the dissolved iron fraction of a model iron oxide according to the concentration of the reductive metal ion in the chemical decontamination reagents with pH 2 and pH 3.

<Experimental Example 3> Evaluation of Metal Oxide Dissolubility According to Concentration Variations of Reductive Metal Ion To investigate metal oxide dissolubility according to concentration of the reductive metal ion of the chemical decontaminant reagent according to the present invention, the concentration of the reductive metal ion of the chemical decontaminant reagent was changed to $26\times10^{-4}$ M, during which the amount of iron component dissolved from the simulated iron oxide was evaluated, and the result is shown in FIG. 3. The chemical decontaminant reagent used herein contained reducing agent (0.07 M), nitric acid (0.15 M adjusted to pH 2, or 0.07 M adjusted to pH 3). The evaluation of the metal oxide dissolubility according to concentration of the reductive metal ion was conducted for 2 hr at 95° C.

Referring to FIG. 3, the dissolved fraction of iron was larger at pH 3 than at pH 2 when a fixed amount of the reductive metal ion was added.

Further, at pH 3, the dissolved fraction of iron was increased according to the increase in the concentration of the added reductive metal ion up to $5\times10^{-4}$ M, but the dissolved fraction of iron was remained almost the same thereafter.

At pH 2, the dissolved fraction of iron was increased according to the increase in the concentration of the added reductive metal ion up to $2\times10^{-3}$ M, but the dissolved fraction of iron was remained almost the same thereafter.

The pH of the chemical decontamination reagent according to an embodiment is adjustable within the range of 1.0-3.7 depending on purposes of decontamination. Based on the result, it was confirmed that dissolubility was higher at pH 3 than pH 2 when the iron oxide was used as a surrogate radioactive metal oxide.

<Experimental Example 4> Evaluation of Decontamination Performance on Radioactive Specimen To evaluate decontamination performance of the chemical decontamination reagent according to an embodiment over an actual radioactive oxide layer on a metal surface, the following experiment was conducted.

First, the first oxidation process was applied to the radioactive specimen of Type 304 stainless steel taken out of a nuclear fuel test loop, under the same condition as the operation of a nuclear power plant, with pretreatment agent NP (65% HNO3 0.44 mL/L+KMnO4 0.61 g/L) at 93° C. for 8 hours. Then, the reductive decontamination process was applied to the radioactive specimen with the chemical decontamination reagent of Example 1 at 95° C. for 8 hours.

Afterwards, the second oxidation process was applied to the radioactive specimen under the same condition as the first oxidation. Again, the second reduction was applied to the radioactive specimen with the chemical decontamination reagent of Example 1. Through the procedure, the radioactivity removed was measured. The result of the measurement is provided in FIG. 4.

Figure 4:
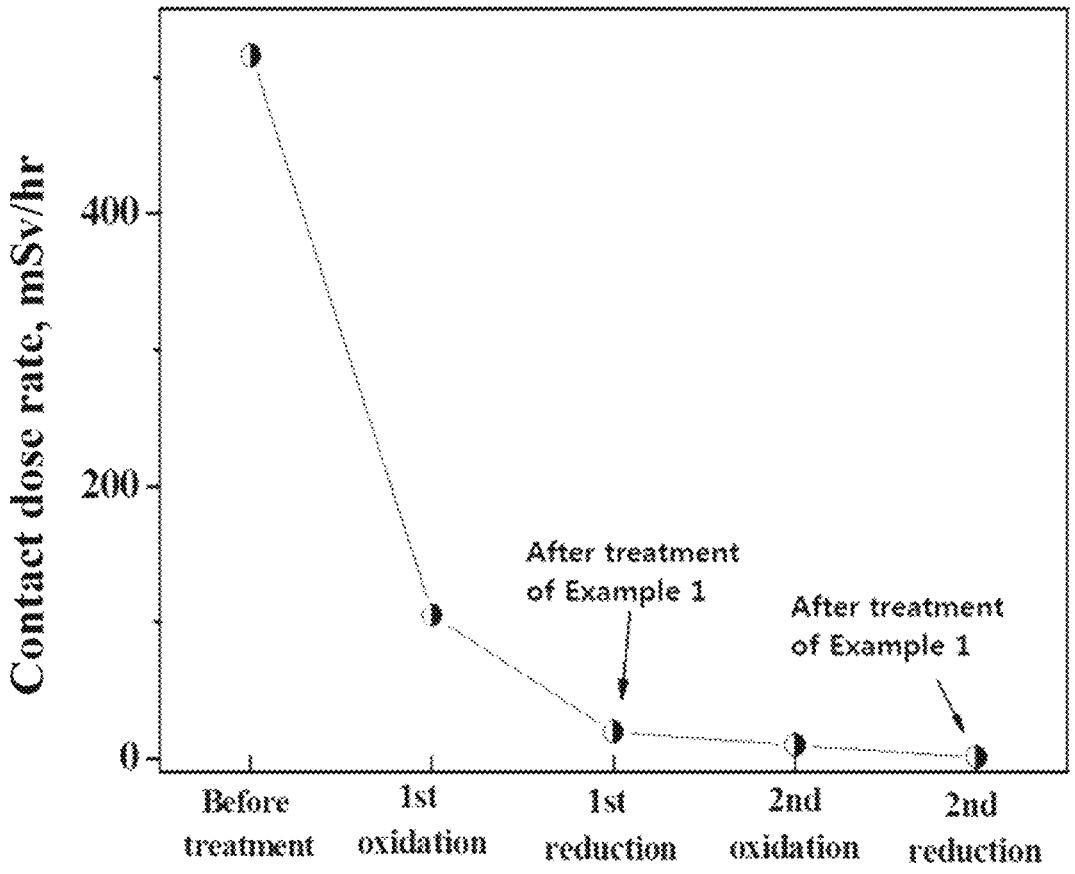
FIG. 4 is a graph showing the change in the surface contact dose rate of the radioactive specimen attached onto a primary system of a nuclear power plant.

Referring to FIG. 4, the initial surface contact dose rate of the radioactive specimen was 516 mSv/hr, but reduced to 105 mSv/hr after the first oxidation. Then, the surface contact dose rate was reduced to 19 mSv/hr after applying the first reduction with the chemical decontamination reagent of Example 1 to the specimen. Subsequently, the surface contact dose rate was reduced to mSv/hr after applying the second oxidation to the specimen. Finally, the surface contact dose rate was reduced to 0.5 mSv/hr after applying the second reduction with the chemical decontamination reagent of Example 1. This is a desirable result.

<Experimental Example 5> Comparison of Corrosion Compatibility on Crevice Specimen To compare corrosion on the crevice-type specimens when treated with the chemical decontamination reagent according to an embodiment and treated with an organic acid decontamination reagent, the following experiment was conducted.

First, the crevice corrosion test specimen fabricated by connecting a pair of Inconel 600 metal plates with a screw was treated with the chemical decontamination reagent of Example 1 to observe the changes of the surface morphology. For comparison, the same specimen was treated with 2000 ppm of an organic acid decontamination reagent solution to observe the changes of the surface morphology. Each experiment was conducted at 95° C. for 20 hours. The result is shown in (a) and (b) of FIG. 5.

Referring to FIG. 5, pitting and localized corrosion were found on the inner side of the crevice contacted to the organic acid decontamination reagent, whereas the corrosion was hardly found on the crevice treated with the chemical decontamination reagent of Example 1.

<Experimental Example 6> Decomposition of Reducing Agent in Chemical Decontamination Reagent by Oxidizing Agent To evaluate the secondary waste reducing effect, which is demonstrated by decomposition of a main reducing agent present in the chemical decontamination reagent according to an embodiment with an oxidizing agent, the following experiment was conducted.

First, 3 ml of the chemical decontamination reagent was prepared according to Example 1.

Next, the oxidation-reduction titration was performed on the chemical decontamination reagent prepared in accordance with Example 1 according to an embodiment by using 3.16 g/L $KMnO_4$ solution as a pretreatment agent before oxidation to evaluate decomposition efficiency of the reducing agent present in the chemical decontamination reagent. The result thereof is provided in FIG. 6.

Referring to FIG. 6, the reducing agent present in the chemical decontamination reagent reacted quantitatively with $KMnO_4$, the pretreatment agent before oxidation, and was also completely decomposed.

<Experimental Example 7> Comparison of Decontamination Performances Between Organic Acid Decontamination Reagent and Chemical Decontamination Reagent According to an Embodiment To compare decontamination performances of a conventional organic acid decontamination reagent and the chemical decontamination reagent according to an embodiment, the following experiment was conducted.

First, the radioactive surface of SUS 304 of the primary system was pre-treated with NP, a pretreatment agent.

Next, the pretreated radioactive SUS 304 of the primary system was treated with the chemical decontamination reagent prepared in accordance with Example 1 according to an embodiment.

After pre-treating the radioactive surface of SUS 304 of the primary system with a pretreatment agent NP, the radioactive surface was treated with conventional chemical decontamination reagents, CITROX (2.5 wt % oxalic acid, 5 wt % ammonium citrate dibasic, and 2 wt % ferric nitrate) and LOMI (picolinic acid $1\text{-}2\times10^{-2}$M, $V^{+2}$ ion $2\text{-}4\times10^{-3}$M, formic acid $1\text{-}2\times10^{-2}$M), respectively. Afterwards, the decontamination factors (surface contact dose rate before decontamination/surface contact dose rate after decontamination) were calculated based on the SUS 304 treated with the chemical decontamination reagent prepared in accordance with Example 1 and the SUS 304 treated with CITROX and LOMI. The result of the calculation is provided in FIG. 7.

Referring to FIG. 7, the decontamination factor was 10 and 20 when treated with NP-CITROX and NP-LOMI, respectively, whereas the decontamination factor was 27 when treated once with the chemical decontamination reagent of Example 1 after applying the NP treatment once.

The foregoing exemplary embodiments and advantages are merely exemplary and are not to be construed as limiting the present invention. The present teaching can be readily applied to other types of apparatuses. Also, the description of the exemplary embodiments of the present inventive concept is intended to be illustrative, and not to limit the scope of the claims.

What is claimed is:

1. A chemical decontamination method, comprising a step of contacting a chemical decontamination reagent to a metal of a nuclear power plant covered with a radioactive oxide layer at a temperature range of 70° C. to 140° C. and a pH range of 1.0 to 3.7, Wherein the chemical decontamination reagent comprises a reducing agent, a reductive metal ion, and an acid, the acid consisting only of inorganic acid, for removal of the radioactive oxide layer on a surface of the metal, the chemical decontamination reagent being devoid of an organic chelating agent, and wherein the reducing agent is $N_2H_4$, the reductive metal ion is $Cu^+$, and the inorganic acid is $HNO_3$ or $H_2SO_4$.

2. The chemical decontamination method according to claim 1, wherein the metal is one or more selected from the group consisting of stainless steel, Inconel steel, and zirconium alloy.

3. The chemical decontamination method according to claim 1, wherein a concentration of the reducing agent is in a range of $5\times10^{-4}$-0.5 M.

4. The chemical decontamination method according to claim 1, wherein a concentration of the reductive metal ion is in a range of $1\times10^{-5}$-0.1 M.

5. The chemical decontamination method according to claim 1, wherein a concentration of the inorganic acid is in a range of $1\times10^{-4}$-0.5 M.

6. The chemical decontamination method according to claim 1, wherein the reductive metal ion is added in a form of ion or ion pair with the addition of a metal salt.

7. The chemical decontamination method according to claim 1, wherein the metal is immersed in the chemical decontamination reagent of claim 1.

8. The chemical decontamination method according to claim 1, wherein the chemical decontamination reagent of claim 1 is passed through an inside of systems or loop of the nuclear power plant.

9. The chemical decontamination method according to claim 1, wherein the method is performed for 2-26 hours.

* * * * *